US012661753B2

(12) United States Patent
Seamons et al.

(10) Patent No.: US 12,661,753 B2
(45) Date of Patent: Jun. 23, 2026

(54) MODULAR BORE POLISHING DEVICES, AND ASSOCIATED SYSTEMS AND METHODS

(71) Applicant: Blue Origin Manufacturing LLC, Huntsville, AL (US)

(72) Inventors: Nicolaas K. Seamons, Bellingham, WA (US); Jordan Avery Wagner, Bellevue, WA (US)

(73) Assignee: Blue Origin Manufacturing, LLC, Huntsville, AL (US)

( * ) Notice: Subject to any disclaimer, the term of this patent is extended or adjusted under 35 U.S.C. 154(b) by 331 days.

(21) Appl. No.: 18/532,936

(22) Filed: Dec. 7, 2023

(65) Prior Publication Data

US 2025/0187130 A1 Jun. 12, 2025

(51) Int. Cl.
*B24B 5/40* (2006.01)

(52) U.S. Cl.
CPC ..... *B24B 5/40* (2013.01)

(58) Field of Classification Search
CPC ..... B24B 5/40
See application file for complete search history.

(56) References Cited

U.S. PATENT DOCUMENTS 2,031,156 A 2/1936 Gillett et al.
2,218,538 A * 10/1940 Knowlton ..... B24D 9/04 451/500
2,332,463 A 10/1943 Palotce
2,340,767 A 2/1944 Prange
2,342,599 A 2/1944 Peterson et al.
2,376,851 A 5/1945 Sunnen
2,411,633 A 11/1946 Oberholtz
2,412,419 A 12/1946 Palotsee
2,443,941 A 6/1948 Wilkerson
(Continued)

FOREIGN PATENT DOCUMENTS

CN 109968121 7/2019
GB 870588 A * 6/1961
KR 100547640 8/2004

OTHER PUBLICATIONS

Sunnen Catalog: Above and Beyond Honing X-GH-2900I, "Honing Tools—Tooling & Abrasive Selection Guide," www.sunnen.com, 2009, 60 pages, accessed Mar. 9, 2023.

*Primary Examiner* — Eldon T Brockman
(74) *Attorney, Agent, or Firm* — Hogan Lovells US LLP

(57) ABSTRACT

A representative tool system for polishing and/or finishing a surface can include an arbor portion and an interchangeable (i.e., modular) head portion. The arbor portion can include a body portion, one or more media collection elements, a rotation mechanism positioned to rotate the one or more media collection elements relative to the body portion, and one or more media distribution elements. The head portion can include a media distribution region for receiving a media distribution element, a media collection region for receiving a media collection element, and media channels connecting the media distribution region and the media collection region to one or more openings at the exterior perimeter of the head portion for passing the media to the exterior perimeter of the head portion. In some embodiments, the head portion can carry the one or more media collection elements.

24 Claims, 13 Drawing Sheets

(56) References Cited

U.S. PATENT DOCUMENTS

| | | | | | |
|---|---|---|---|---|---|
| 2,465,225 | A | * | 3/1949 | Haren | B24D 9/003 451/489 |
| 2,475,555 | A | * | 7/1949 | Saalinger | B24D 9/04 451/500 |
| 2,627,707 | A | | 2/1953 | Brooks | |
| 2,654,192 | A | * | 10/1953 | Lynch | B24D 9/04 451/500 |
| 2,657,507 | A | | 11/1953 | Seymour | |
| 2,800,750 | A | | 7/1957 | Field | |
| 2,988,859 | A | | 6/1961 | Chaffey | |
| 2,989,825 | A | | 6/1961 | Smith | |
| 4,070,798 | A | * | 1/1978 | Emain | B24D 9/06 451/493 |
| 7,413,498 | B2 | * | 8/2008 | Omata | B24B 53/007 451/303 |
| 9,789,581 | B2 | | 10/2017 | Cloutier | |
| 2004/0157530 | A1 | | 8/2004 | Omata et al. | |

* cited by examiner

MODULAR BORE POLISHING DEVICES, AND ASSOCIATED SYSTEMS AND METHODS

TECHNICAL FIELD

The present disclosure is directed generally to devices for polishing and/or finishing internal surfaces of bores or other surfaces, and associated systems and methods.

BACKGROUND

Mechanical and aerospace systems often require components formed with high degrees of precision and finishing, and which often must be produced with efficiency and consistency. For example, bores in machined parts often require smooth interior surfaces. This can be especially true for actuator housings for valve assemblies used in cryogenic temperatures found in rocket engine applications. When seals are cold, they become harder and less pliable, so a smoother surface improves the seal's ability to function by not requiring the seal to adapt to an imprecise surface.

One conventional technique to polish an interior surface of a bore is to hold a section of abrasive paper on a fingertip or at the end of a stick while manually pressing the abrasive paper against the interior surface, rotating the workpiece, and moving the paper axially along the bore. The operator periodically replaces the abrasive paper with a new section and repeats the process until the surface is satisfactorily smooth. The existing process can involve safety hazards for the operator, result in inconsistent finishes (due to inconsistent pressure), and reduced productivity due to the time spent replacing the paper or due to inconsistent operator skill. Some machine techniques exist for polishing bores, but such techniques typically require dedicated honing, lapping, or superfinishing equipment that can be too expensive to justify for some parts.

Embodiments of the present technology are directed to addressing these challenges and other challenges.

BRIEF DESCRIPTION OF THE DRAWINGS

In the drawings, wherein the same reference number indicates the same element throughout the views.

DETAILED DESCRIPTION

Figure 1:
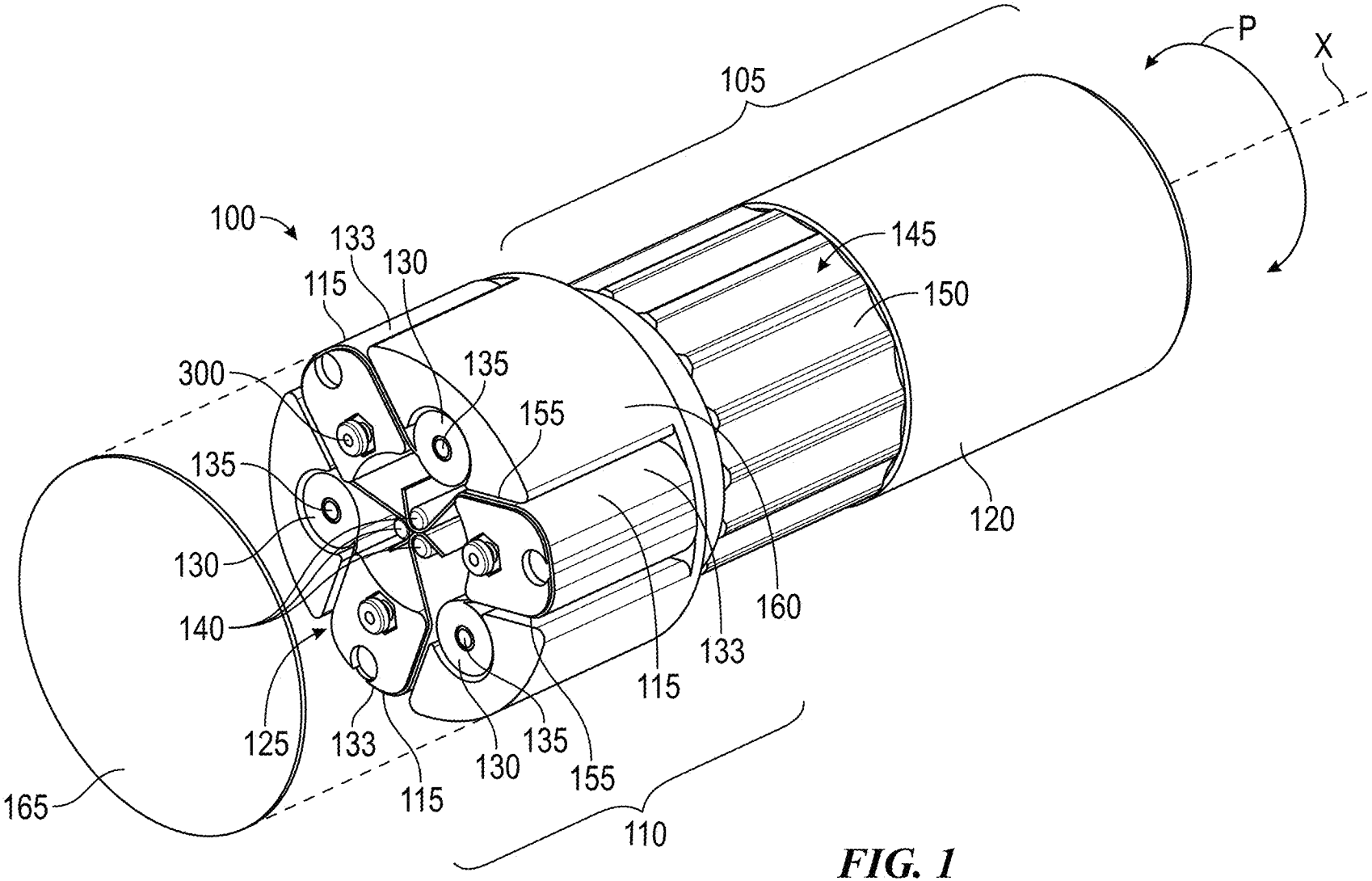
FIG. 1 illustrates a partially-schematic, partially exploded perspective view of a tool system configured in accordance with embodiments of the present technology.

Embodiments of the technology disclosed herein are directed generally to bore polishing devices (which may optionally include modular elements), and associated systems and methods. Although specific implementations of the present technology can include tools for polishing bores for valves in an aerospace system, the present technology can also be implemented in other systems or industries that require polished or at least partially finished bores.

In general, some tool systems configured in accordance with embodiments of the present technology can include a cylindrical head portion that radially preloads an abrasive paper against the workpiece surface. The workpiece and/or the tool system (or components of the tool system) can rotate and/or move axially relative to the other to polish or work the surface in other ways. The tool system can store the abrasive paper in one or more rolls. A user can twist a portion of the tool system (such as a knob or control sleeve) to operate a collection reel (such as a clutched one-way reel) to collect used paper and position new paper. In some embodiments, the tool system can include multiple rolls for multiple polishing points to further reduce the work time. Head portions of the devices can be removable and replaceable (i.e., modular) with varied sizes to accommodate differently sized bores using the same base portion (i.e., an arbor portion) to carry the various head portions.

A representative tool system for polishing and/or finishing a surface (e.g., an interior surface of a bore) can include an arbor portion and a head portion. In some embodiments, the arbor portion can include a body portion, one or more media collection elements carried by the body portion, a rotation mechanism carried by the body portion and positioned to rotate the one or more media collection elements relative to the body portion, and one or more media distribution elements. In some embodiments, the head portion (which can be interchangeable/modular with other head portions) can include one or more media distribution regions positioned to receive individual media distribution elements, a media collection region positioned to receive the one or more media collection elements, at least one outbound media channel extending from a corresponding media distribution region to a first opening at an exterior perimeter of the head portion, and at least one inbound media channel extending from a second opening at the exterior perimeter of the head portion, to the media collection region. The polishing and/or finishing media can be stored and distributed to the exterior perimeter of the head portion to periodically refresh and/or replace the media, using the rotation mechanism.

Another representative tool system for polishing and/or finishing a surface (e.g., an interior surface of a bore) can include a first rotatable shaft, a second rotatable shaft, a media collection element connected to the first rotatable shaft and positioned to rotate when the first rotatable shaft rotates, a head portion connected to the second rotatable shaft and positioned to rotate when the second rotatable shaft rotates, and a transmission connecting the first rotatable shaft to the second rotatable shaft. The transmission can be configured to cause the second rotatable shaft and the head portion to rotate slower than the first rotatable shaft. The head portion can support a working media for polishing and/or finishing the surface. For example, the head portion can include a media distribution region, one or more openings at an external peripheral surface of the head portion, and one or more pathways connecting the media distribution region to the one or more openings and to the media collection element. As the head portion and/or the surface rotates relative to the other, the media is positioned on the external peripheral surface of the head portion and moved against the surface. The relative rotation between the first rotatable shaft and the head portion causes the media to gather on the media collection element, pulling it from the media distribution region to continually refresh the portion of the media that is moved against the surface while the tool system is operating.

Several details describing structures and processes that are well-known and often associated with abrasive paper, spools, or other known elements are not set forth in the following description to avoid obscuring other aspects of the disclosure. Moreover, although the following disclosure sets forth several embodiments, several other embodiments can have configurations, arrangements, and/or components that are different than those described in this section. In particular, other embodiments may have additional elements, and/or may lack one or more of the elements described below with reference to FIGS. 1-13B.

FIG. 1 illustrates a partially-schematic, partially exploded perspective view of a tool system 100 configured in accordance with embodiments of the present technology. In some embodiments, the tool system 100 can include an arbor portion 105 and a head portion 110, which can optionally be coaxial with the arbor portion 105. Although the arbor portion 105 and the head portion 110 are illustrated as being generally cylindrical, other embodiments can include other suitable shapes (e.g., a polygon having a suitable number of sides). As explained in further detail below, the head portion 110 can support one or more polishing elements 115 for polishing the interior surface of a bore. The arbor portion 105 can be restrained in a rotating device, such as a lathe, which can rotate the arbor portion 105 and the head portion 110 to polish the interior surface of the bore using the one or more polishing elements 115. In some embodiments, the tool system 100 can be fixed while the bore rotates around the tool system 100. In some embodiments, the tool system 100 and the bore can be rotated relative to each other. Some polishing elements 115 can wear away and/or otherwise become less effective during use, so in some embodiments, the arbor portion 105 includes a body portion 120 that supports a distribution and collection system 125 for refreshing and/or replacing the one or more polishing elements 115. The body portion 120 can be positionable or positioned in the lathe.

Figure 2:
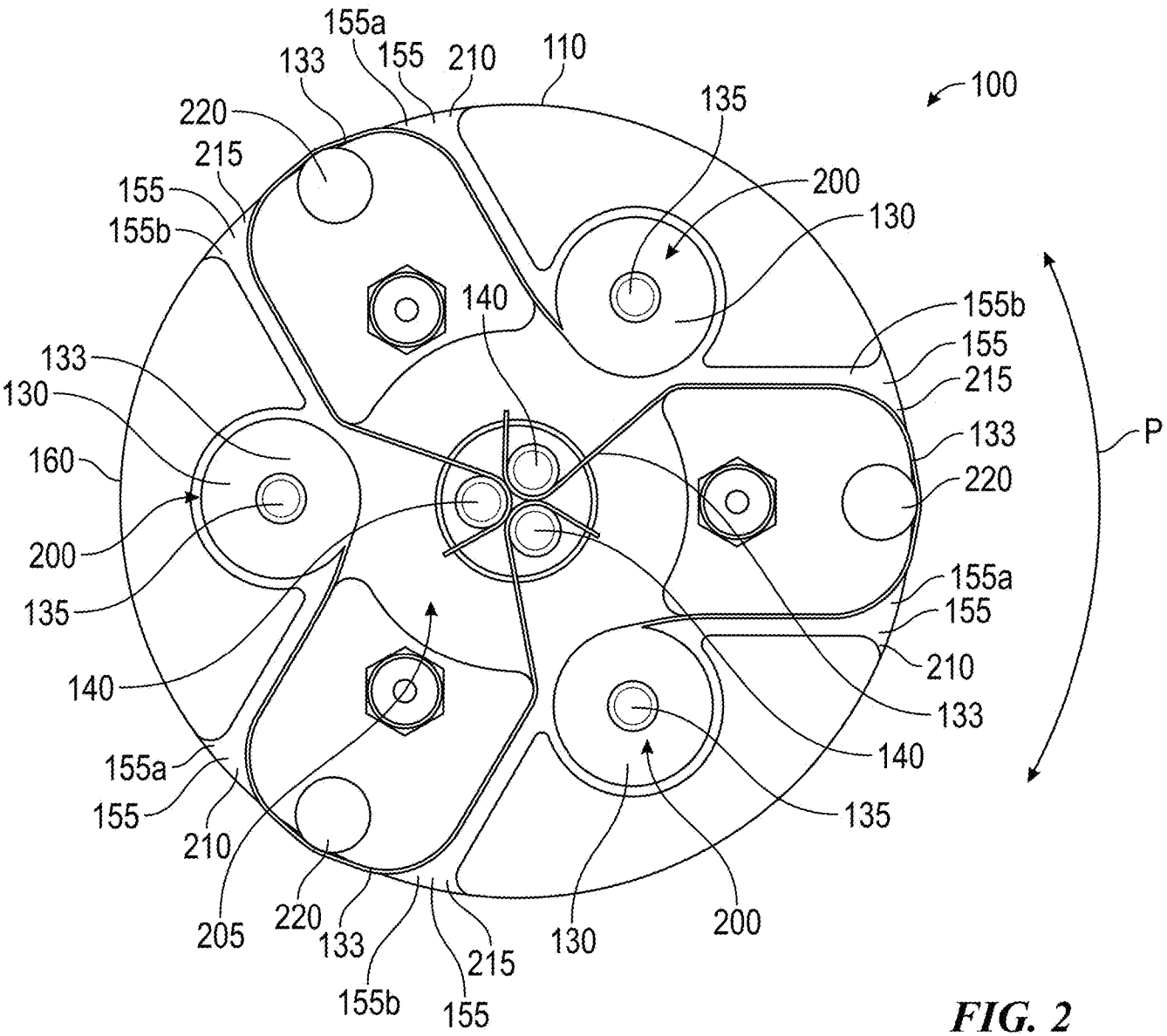
FIG. 2 illustrates a partially-schematic end view of a portion of the tool system shown in FIG. 1.

FIG. 2 illustrates a partially-schematic end view of a portion of the tool system 100 shown in FIG. 1. With reference to FIGS. 1 and 2, in some embodiments, the one or more polishing elements 115 can include abrasive paper 133, which can be stored in one or more reels or rolls 130 for distribution and collection by the distribution and collection system 125. Abrasive paper can include a paper substrate lined and/or coated with abrasive material such as diamond, aluminum oxide, and/or another grit or abrasive material. The distribution and collection system 125 can include one or more media distribution elements 135, which can include one or more posts or spools extending longitudinally from the arbor portion 105 and positioned to support a corresponding reel and/or roll 130 of the abrasive paper 133. The distribution and collection system 125 can further include one or more media collection elements 140. The one or more media collection elements 140 can include one or more reels and/or posts extending longitudinally from the arbor portion 105.

The media collection elements 140 gather the abrasive paper 133 from the media distribution elements 135 after the abrasive paper 133 has passed through the head portion 110 (e.g., after the abrasive paper 133 has been used). The distribution and collection system 125 enables an operator of the tool system 100 to periodically refresh the abrasive paper 133 as needed, as explained in further detail below. In some embodiments, one or more (such as all) of the media collection elements 140 can be positioned generally in a radially central portion of the tool system 100, with the one or more media distribution elements 135 being positioned radially outwardly from the media collection elements 140, although in other embodiments, the media distribution elements can be in the radially central portion and the media collection elements 140 can be positioned radially outwardly. Other embodiments can include other relative positions of the various elements of the distribution and collection system 125.

The distribution and collection system 125 can further include a rotation mechanism 145 (see FIG. 1) carried by the body portion 120 and positioned to rotate the one or more media collection elements 140 relative to the body portion 120 to cause the abrasive paper to gather on the media collection elements 140. FIG. 1 illustrates only a portion of the rotation mechanism 145, which is described in additional detail below, and which can include a one-way clutch mechanism. The rotation mechanism 145 can include a twist ring 150 carried by the body portion 120 and operably connected to the one-way clutch mechanism for a user to cause the distribution and collection system 125 to refresh and/or replace the abrasive paper.

In operation, the abrasive paper 133 (and/or other suitable polishing elements 115) extends from the reels or rolls 130, outwardly through one or more pathways or channels 155 in the head portion 110, around a portion of an exterior peripheral surface 160 of the head portion 110, and inwardly through the one or more channels 155 to the media collection elements 140. When the distribution and collection system 125 rotates the one or more media collection elements 140 about the longitudinal axis X (e.g., pathway P) of the tool system 100, the media collection elements 140 pull the abrasive paper 133 through the channels 155 from the media distribution elements 135, thereby changing the portion of the abrasive paper 133 positioned on the exterior peripheral surface 160 of the head portion 110 so that the new portion of the abrasive paper 133 can engage the surface of the bore to polish the bore. As shown in FIG. 1, in some embodiments, the media collection elements 140 can be in the form of one or more posts about which the abrasive paper 133 can be routed, in order to cause the abrasive paper 133 to wind around the media collection elements 140 when the distribution and collection system 125 operates. In some embodiments, an optional cap or cover element 165 can be removably attached to the head portion 110 to cover the media collection elements 140, the media distribution elements 135, the abrasive paper 133, and/or other elements of the head portion 110.

With specific reference to FIG. 2, in some embodiments, the head portion 110 includes one or more media distribution regions 200 for receiving and/or containing one or more of the individual media distribution elements 135 and/or the abrasive paper 133. In some embodiments, the head portion 110 includes one or more media collection regions 205 positioned to receive and/or contain the media collection elements 140 and/or the abrasive paper 133. The media distribution regions 200 and the media collection regions 205 can be in the form of cavities in the head portion 110. The channels 155 can include outbound media channels 155*a*, which extend from a corresponding media distribution region 200, to first openings 210 at the exterior peripheral surface 160 of the head portion 110. The channels 155 can further include inbound media channels 155*b*, which extend from second openings 215 at the exterior peripheral surface 160 of the head portion 110 to the media collection region 205. During operation of the distribution and collection system 125, the abrasive paper 133 (or other polishing element 115) passes outwardly through the outbound media channels 155*a*, across the portion of the surface 160, and back into the head portion 110 through the inbound media channels 155*b*. Although, as illustrated, some embodiments can include three media distribution regions 200 and three corresponding reels or rolls 130 of abrasive paper 133, other embodiments can include more or fewer media distribution regions 200 and corresponding reels or rolls 130.

In some embodiments, the head portion 110 can include one or more peripheral elements 220 supported generally at the perimeter of the head portion 110 and/or embedded in the exterior peripheral surface 160. The peripheral elements 220 may extend radially outwardly from the head portion 110 beyond the remainder of the surface 160 to tend to push the abrasive paper 133 radially outwardly to encourage engagement of the abrasive paper 133 with the bore being polished. In other words, the peripheral elements 220 preload the abrasive paper 133 against the bore. In some embodiments, a peripheral element 220 can be located between each first opening 210 and second opening 215. In some embodiments, the peripheral elements can include flexible and/or resilient elements, such as a foam and/or rubber material.

Figure 3:
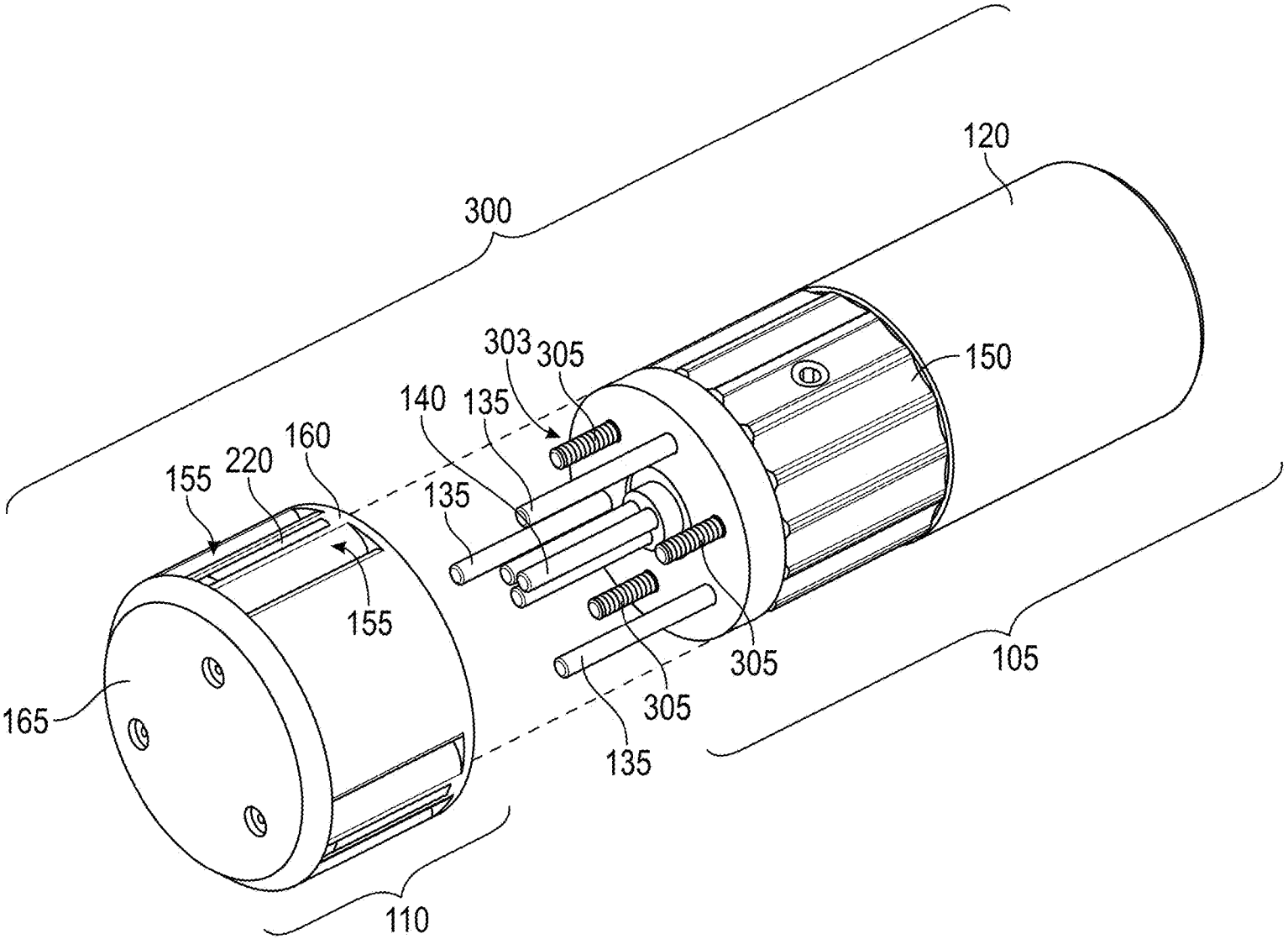
FIG. 3 illustrates a partially-schematic, partially exploded perspective view of a tool system configured in accordance with embodiments of the present technology.

FIG. 3 illustrates a partially-schematic, partially exploded perspective view of a tool system 300 configured in accordance with embodiments of the present technology. The abrasive paper is not visible in FIG. 3, either because it is not yet loaded in the head portion 110 or because it is loaded in (and therefore concealed by) the head portion 110 and ready to be aligned with the distribution and collection system 125. The tool system 300 can be generally similar to the tool system 100 described above with regard to FIGS. 1 and 2, but in some embodiments, the head portion 110 is attachable to, removable from, and/or replaceable upon, the arbor portion 105 via one or more attachment mechanisms 303, such as one or more fastener elements 305 extending into the arbor portion 105 and/or into the head portion 110.

Figure 4:
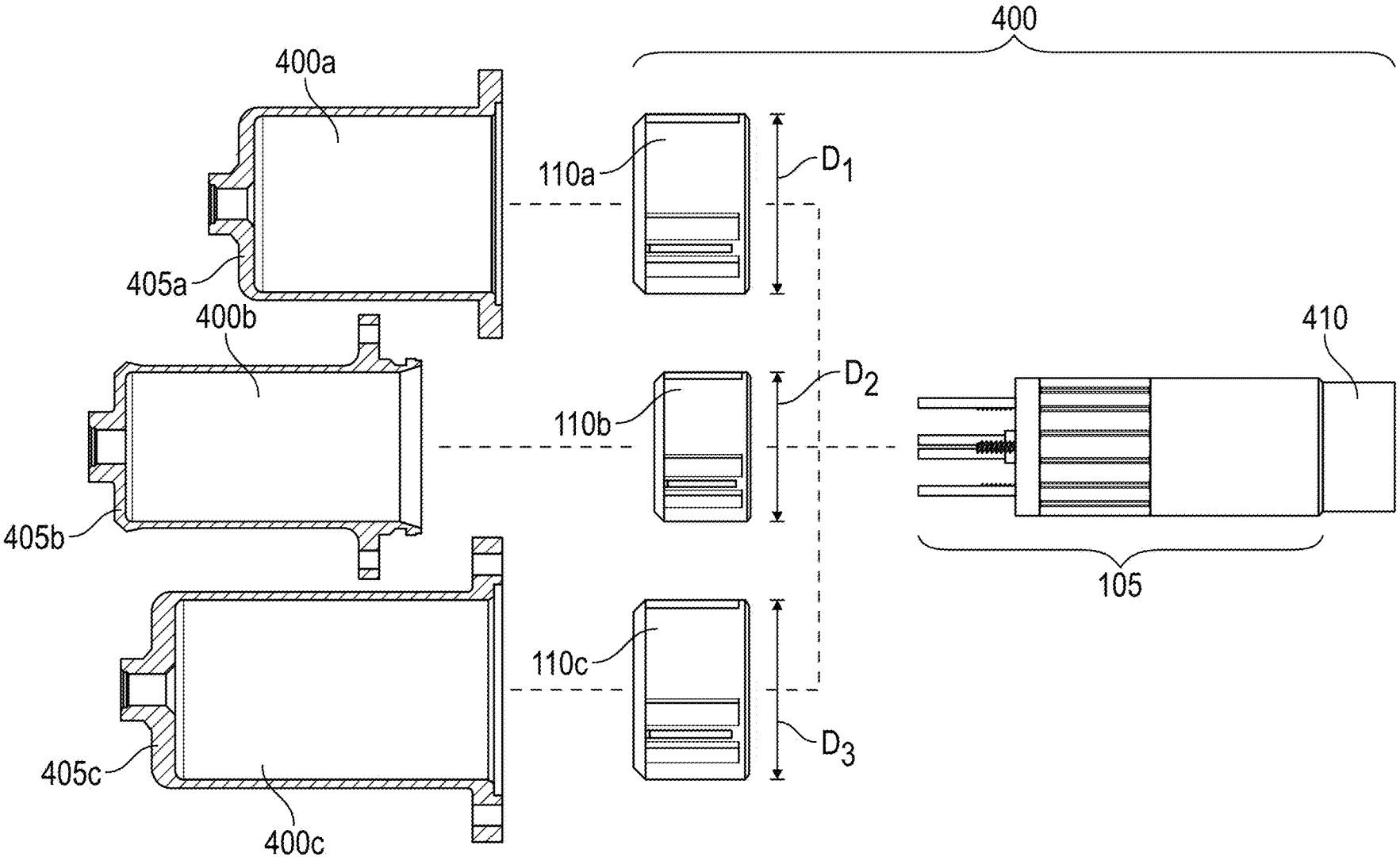
FIG. 4 illustrates a schematic side view of a tool system configured in accordance with embodiments of the present technology.

FIG. 4 illustrates a schematic side view of a tool system 400 configured in accordance with embodiments of the present technology. The tool system 400 can be generally similar to the tool systems 100, 300 described above with regard to FIGS. 1-3. In addition, the tool system 400 can include a plurality of head portions 110*a*, 110*b*, 110*c*, each of which is attachable to, and/or removable from, the arbor portion 105. The head portions 110*a*, 110*b*, 110*c* can have different outer/external diameters D1, D2, D3 to accommodate differently sized bores 400*a*, 400*b*, 400*c* in components 405*a*, 405*b*, 405*c*. Accordingly, embodiments of the present technology provide modularity and interchangeability among head portions to enable operators to efficiently select an appropriately-sized head portion for a polishing task. Such modularity and interchangeability also enable operators to pre-load polishing elements 115 (such as abrasive paper 133) into a head to quickly and efficiently reload an arbor portion 105. In some embodiments, the arbor portion 105 can include and/or carry a flexible arbor support structure 410, which can transmit the rotational force from a lathe while absorbing and/or adjusting to axial offsets and/or other misalignments between components. The flexible arbor support structure 410 can be integral with and/or attachable to an end of the arbor portion 105 opposite the head portion (e.g., 110 (see FIG. 3), 110*a*, 110*b*, 110*c*).

Figure 5:
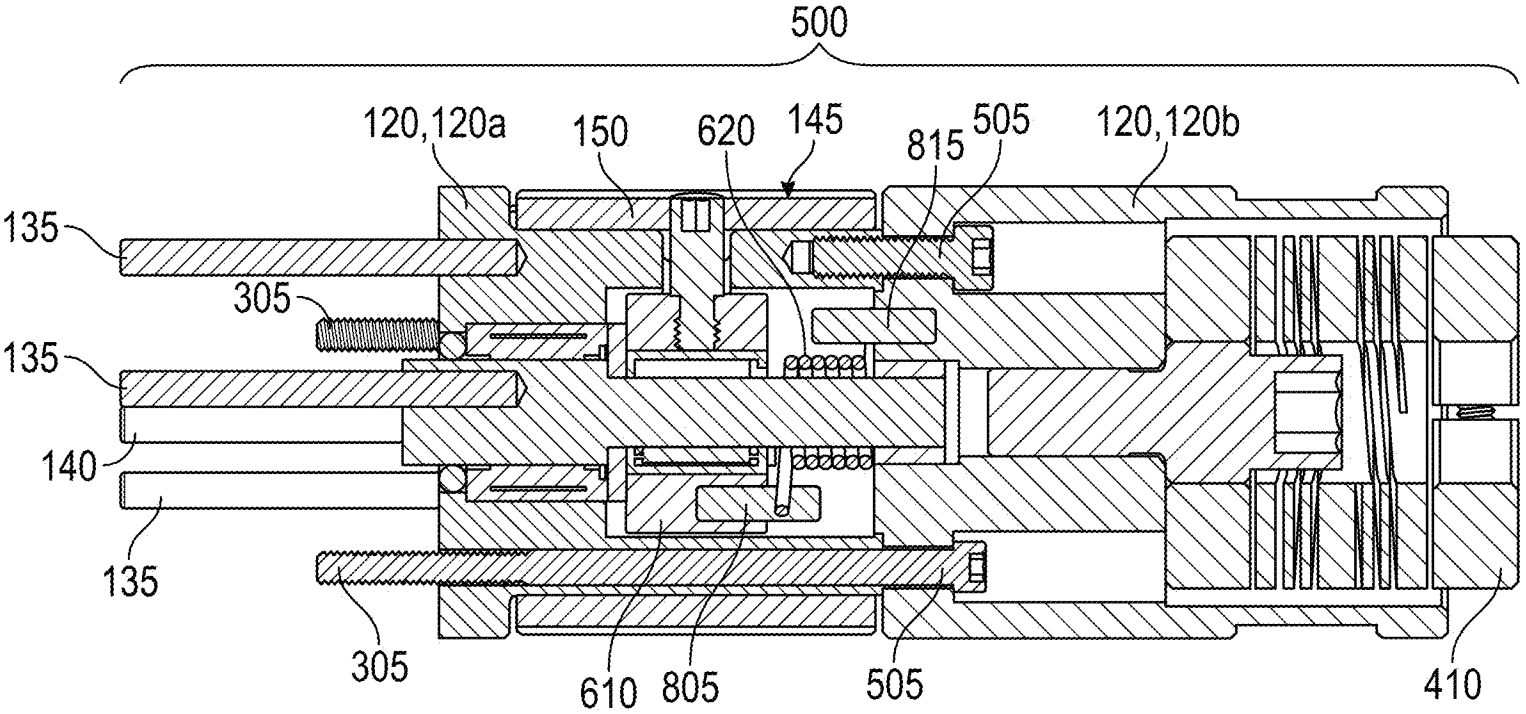
FIG. 5 illustrates a partially-schematic, side cross-sectional view of an arbor portion of a tool system configured in accordance with embodiments of the present technology.

FIG. 5 illustrates a partially-schematic side cross-sectional view of an arbor portion 500 configured in accordance with embodiments of the present technology, such as the arbor portion 105 described above with regard to FIGS. 1-4. In particular, FIG. 5 shows portions of the rotation mechanism 145, which is carried in the body portion 120. In some embodiments, the body portion 120 can include two body portion components 120*a*, 120*b* that are connected together (e.g., with one or more fasteners 505), however, in other embodiments, the body portion 120 can be a single body element (i.e., with body portion components 120*a*, 120*b* being integral). Constructing the body portion 120 in multiple portion components can simplify manufacturing (e.g., machining and/or assembly) of the tool system. For example, a first body portion component (e.g., 120*a*) can carry the rotation mechanism 145. Further details of the rotation mechanism 145 are provided below in connection with FIGS. 6 and 7.

Figure 6:
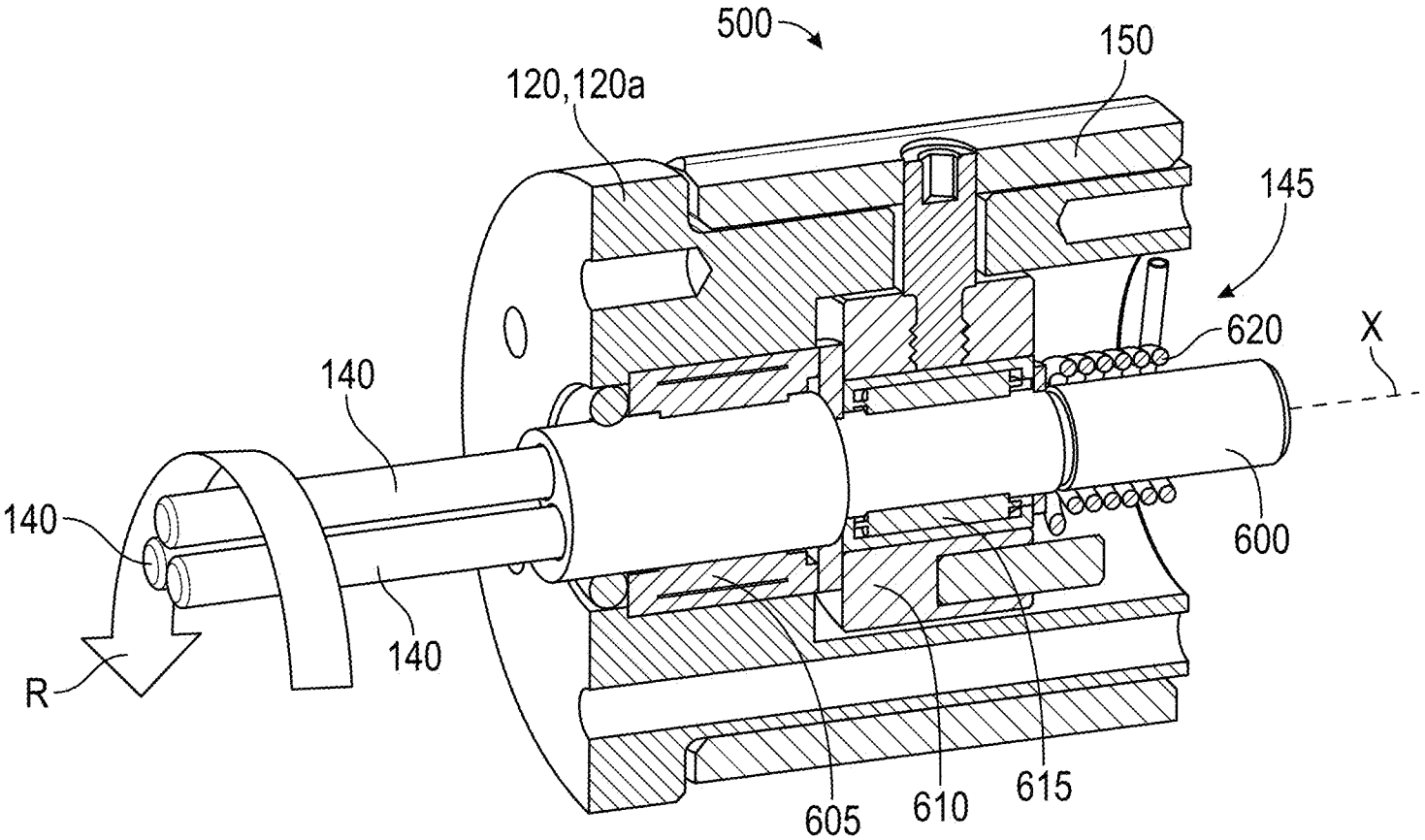
FIG. 6 illustrates a partially-schematic, cross-sectional perspective view of part of the arbor portion shown in FIG. 5.
Figure 7:
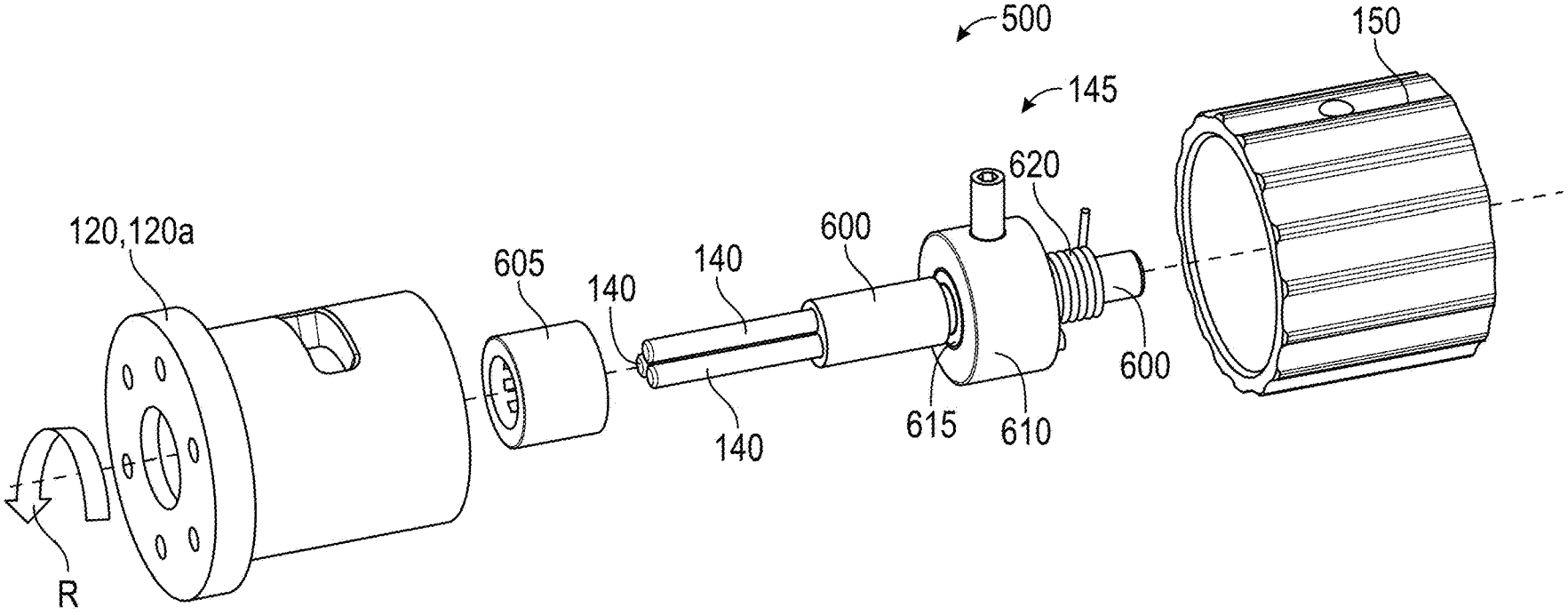
FIG. 7 illustrates a partially-schematic, exploded view of the part of the arbor portion shown in FIG. 6.

FIG. 6 illustrates a partially-schematic cross-sectional perspective view of part of the arbor portion 500 shown in FIG. 5. FIG. 7 illustrates a partially-schematic exploded view of the part of the arbor portion 500 shown in FIG. 6. For ease of understanding, representative components will be introduced, and then their function will be described below. With reference to FIGS. 6 and 7, in some embodiments, the rotation mechanism 145 can include (a) the twist ring 150; (b) an arbor driveshaft 600 (which carries and/or is connected to the one or more media collection elements 140); (c) a first (forward) one-way bearing 605 (e.g., a sprag bearing) positioned between, and connecting, the arbor driveshaft 600 and the body portion 120 (e.g., 120*a*); (d) a clutch ring 610 connected to the twist ring 150; (e) a second (rearward) one-way bearing 615 (e.g., a sprag bearing) connecting the arbor driveshaft 600 and the clutch ring 610; and/or (f) a biasing element 620 (e.g., a return spring).

The rotation mechanism 145 is positioned and configured to rotate the one or more media collection elements 140 relative to the body portion 120 to wind and collect/gather the abrasive paper 133. For purposes of example only, rotating the media collection elements 140 counterclockwise in direction R is illustrated in the Figures and described below, although it is understood that embodiments of the present technology can be configured to wind the abrasive paper 133 in a clockwise direction. In some embodiments, an operator (such as a human operator and/or a machine) can apply a twisting force to the twist ring 150 to rotate the twist ring 150 relative to the body portion 120 (e.g., along counterclockwise direction R). Because the twist ring 150 and the clutch ring 610 are connected, rotating the twist ring 150 causes the clutch ring 610 to rotate (e.g., along counterclockwise direction R). The rearward one-way bearing 615, which can be connected to the arbor driveshaft 600, can be configured to lock in the counterclockwise direction to transmit counterclockwise rotation to the arbor driveshaft 600, but to freewheel in the reverse (clockwise) direction. Accordingly, the clutch ring 610, being connected to the rearward one-way bearing 615, causes the arbor driveshaft 600 to rotate counterclockwise, thereby rotating the media collection elements 140 counterclockwise (e.g., in direction R) to wind the abrasive paper 133.

To resist and/or prevent the abrasive paper 133 from unwinding from the media collection elements 140 (i.e., to resist and/or prevent clockwise rotation of the media collection elements 140), and to help maintain coaxial orientations of the components, the forward one-way bearing 605 can be positioned to resist and/or prevent rotation of the arbor driveshaft 600 along the clockwise direction relative to the body portion 120, while allowing the arbor driveshaft 600 to rotate along the counterclockwise direction.

In some embodiments, the optional biasing element 620 is connected to the clutch ring 610 and the body portion 120 to bias the clutch ring 610 (and the twist ring 150, which is connected to the clutch ring 610) back to its starting position. Accordingly, the rotation mechanism 145 functions as a one-way clutch mechanism to gather the abrasive paper 133 on and/or around the one or more media collection elements 140. Although the rotation mechanism 145 is illustrated and described with particular elements and functions, other embodiments can include other rotation mechanisms configured to cause the media collection elements 140 to rotate in one direction but not the other.

For purposes of illustration and example only, the one or more media collection elements 140 are shown and described as being rotated in the counterclockwise direction R, but in other embodiments the media collection elements 140 can be rotated in a clockwise direction, depending on the configurations of the bearings 605, 615 (i.e., what directions they allow and resist rotation). For example, in some embodiments, the bearings 605, 615 can allow clockwise rotation but prevent counterclockwise rotation thereby reversing the winding direction of rotation of the media collection elements 140. In general, the clutch effect of the rotation mechanism 145 enables the media collection elements 140 to collect used/spent abrasive paper 133 while resisting the tendency of the paper to unwind while the tool system 100 is in use.

Figure 8:
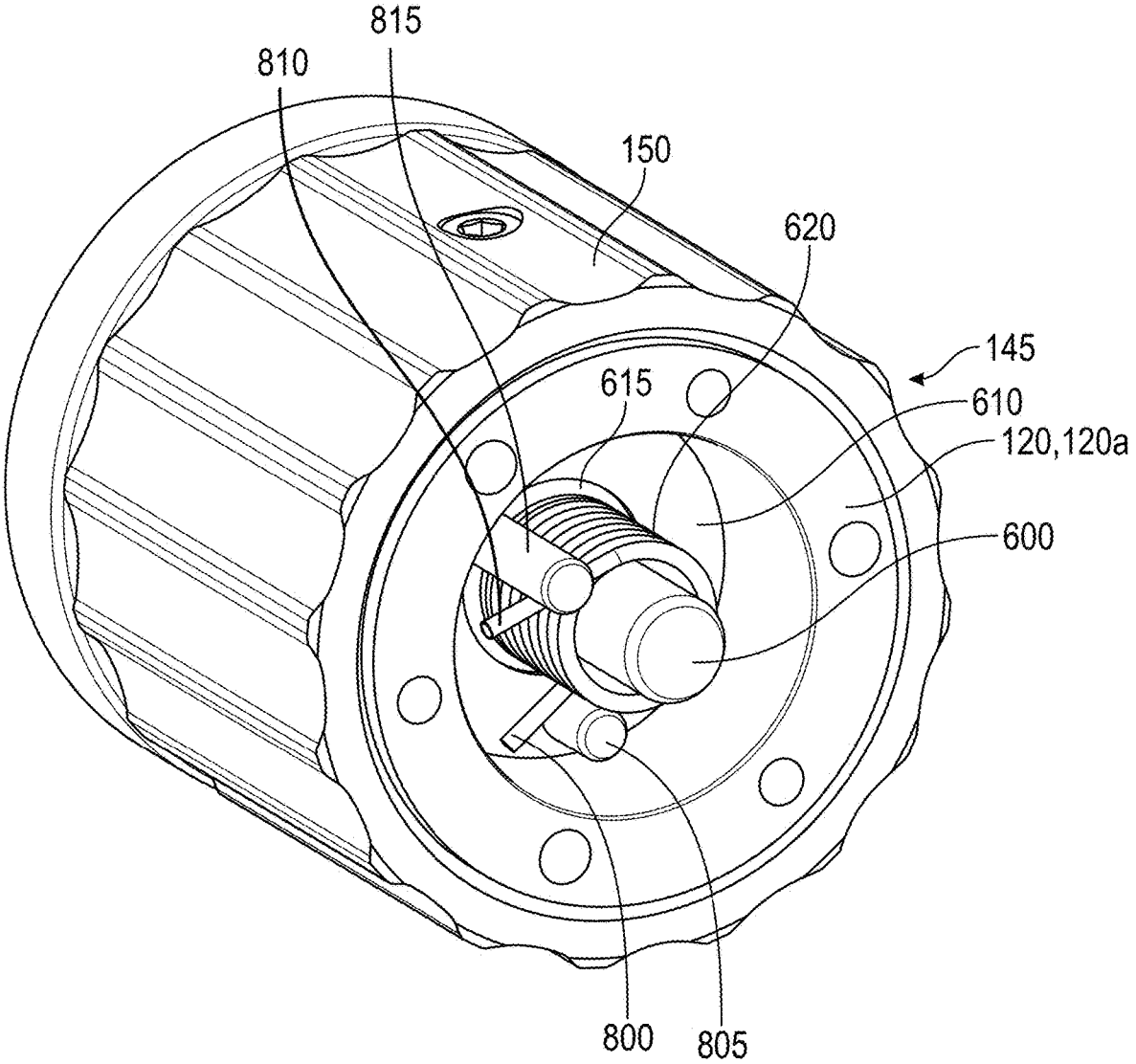
FIG. 8 illustrates a partially-schematic, rear perspective view of portions of a rotation mechanism configured in accordance with embodiments of the present technology.

FIG. 8 illustrates a partially-schematic rear perspective view of portions of a rotation mechanism 145 configured in accordance with embodiments of the present technology. In some embodiments, the biasing element 620 (e.g., in the form of a spring) can include a first end 800 that presses against a clutch pin 805 fixed to the clutch ring 610. The clutch pin 805 can move along an arcuate path when the clutch ring 610 is rotated (e.g., when the twist ring 150 is rotated). The biasing element 620 can further include a second end 810 that presses against a body pin 815. The body pin 815 can be fixed to the body portion 120*b* (e.g., as generally shown in FIG. 5) and/or to another element, such that the clutch pin 805 can move relative to the body pin 815. The biasing element 620 tends to push the twist ring 150 back to its original unrotated position, thereby allowing an operator to repeatedly turn and release the twist ring 150 to wind the abrasive paper without having to turn the twist ring 150 around and around. However, in some embodiments, the biasing element 620 can be omitted and the operator can move the twist ring 150 without assistance to reverse it back to its starting position.

Figure 9:
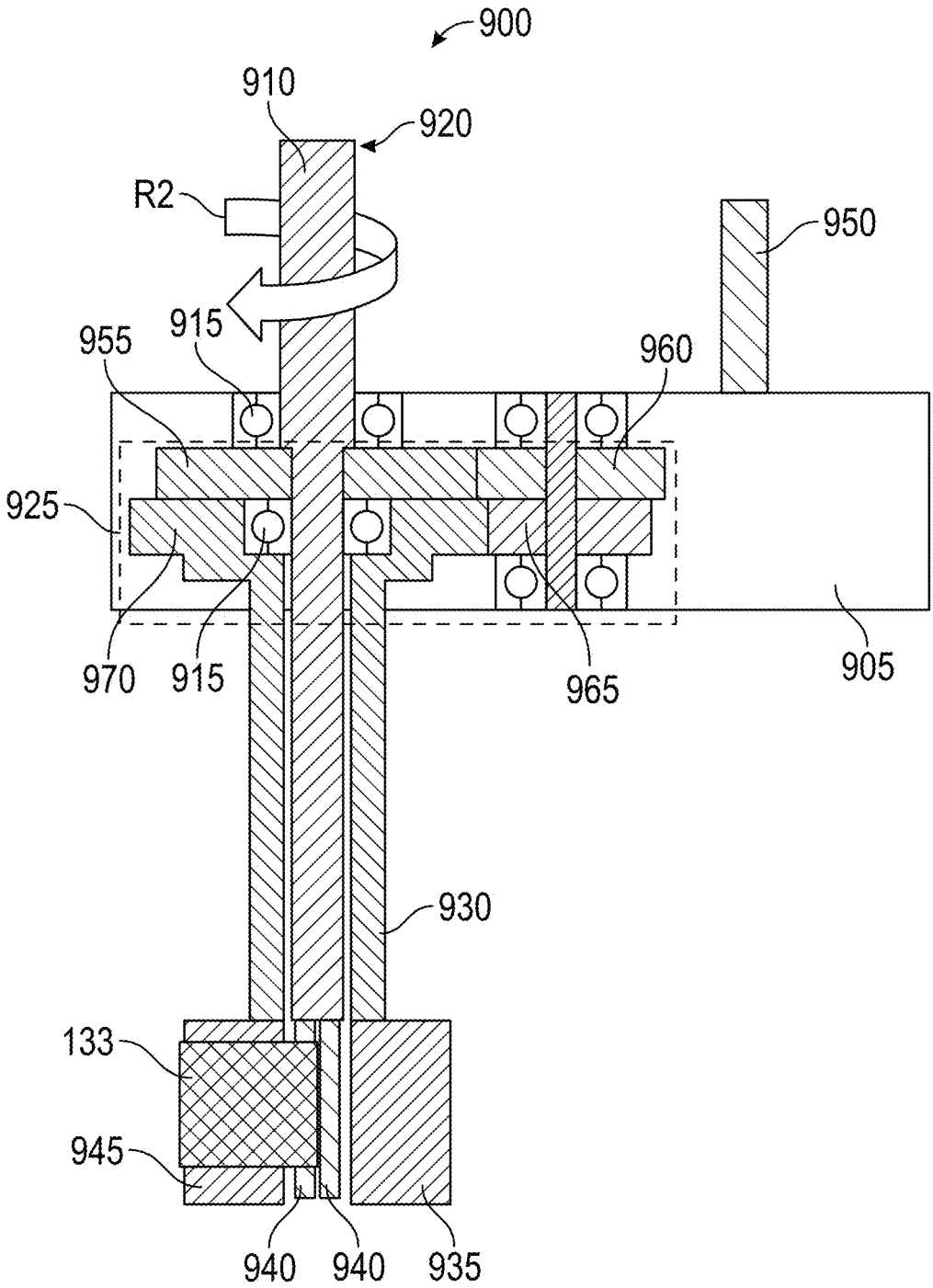
FIG. 9 illustrates a partially-schematic, side cross-sectional view of a tool system configured in accordance with additional embodiments of the present technology.

FIG. 9 illustrates a partially-schematic side cross-sectional view of a tool system 900 configured in accordance with additional embodiments of the present technology. In some embodiments, the tool system 900 automatically replaces the abrasive paper 133 during operation. The tool system 900 can include a body portion 905, which can be in the form of a gearbox for containing components of the tool system 900. A first shaft 910 (e.g., a center shaft) can be positioned to pass through the body portion 905 supported by one or more bearings 915 for enabling rotation of the first shaft 910 relative to the body portion 905. The first shaft 910 can be connected to a rotational input source at a first end 920, such as a machine spindle (e.g., in a lathe) to cause rotation R2 relative to the body portion 905. A gearset 925 can be positioned in, or supported by, the body portion 905. The gearset 925 receives rotation from the first shaft 910 and outputs rotation to a second shaft 930 (e.g., an outer shaft that is adjacent to, or concentrically positioned around, the first shaft 910). In some embodiments, the gearset 925 reduces the speed of the second shaft 930 relative to the first shaft 910, to cause the second shaft 930 to rotate slower than the first shaft 910.

The second shaft 930 can be attached to a head portion 935, which carries new or fresh abrasive paper 133 (e.g., on media distribution elements and/or in media distribution regions similar to those described above with regard to FIGS. 1-8) and positions the abrasive paper 133 against the surface to be worked by the tool system 900. The head portion 935 can be generally similar to the head portions described above with regard to FIGS. 1-8 (e.g., it can be modular, detachable, and/or replaceable on the second shaft 930). The first shaft 910 can include one or more media collection elements 940, such as rod elements projecting longitudinally from the center shaft 910.

In operation, when the first shaft 910 rotates, the second shaft 930 also rotates (via the gearset 925). As the first shaft 910 rotates, it gathers used abrasive paper 133 on the one or more media collection elements 940 by pulling them from the head portion 935. The head portion 935 rotates with the second shaft 930 to slide the abrasive paper 133 across the working surface (e.g., an interior surface of a bore). Regardless of input speed to the first shaft 910, the slightly faster rotation of the first shaft 910 relative to the second shaft 930 causes the abrasive paper 133 to continually refresh at the exterior surface 945 of the head portion 935 and gather on the one or more media collection elements 940. Accordingly, the tool system 900 continually refreshes the abrasive paper 133 during operation. In some embodiments, the head portion 935 can include features of the head portions described above with regard to FIGS. 1-8, such as one or more media distribution elements, one or more media distribution regions, one or more peripheral elements, modularity, etc.

In some embodiments, the tool system 900 can include an anti-rotation pin 950 connected to the body portion 905. The anti-rotation pin 950 can be connectable to a fixed element in a workshop, such as a fixed portion of a lathe or other rotation source, to resist or prevent the body portion 905 from rotating. In some embodiments, the gearset 925 can include a first gear 955 connected or attached to the first shaft 910 to rotate with the first shaft 910, a second gear 960 rotatably supported in or on the body portion 905 and being in geared engagement with the first gear 955, a third gear 965 connected or attached to the second gear 960 (e.g., coaxial with the second gear 960) to rotate with the second gear 960 and rotatably supported in or on the body portion 905, and a fourth gear 970 in geared engagement with the third gear 965. The fourth gear 970 can be attached to or integral with the second shaft 930 to rotate with the second shaft 930. The ratios of the gears 955, 960, 965, 970 can be selected to cause the second shaft 930 to rotate at a different speed than the first shaft 910 (e.g., to cause the second shaft 930 to rotate slightly more slowly than the first shaft 910). Other embodiments can include other arrangements of gears and/or other transmission devices suitable for causing the second shaft 930 to rotate at a reduced speed relative to the first shaft 910.

Figure 10:
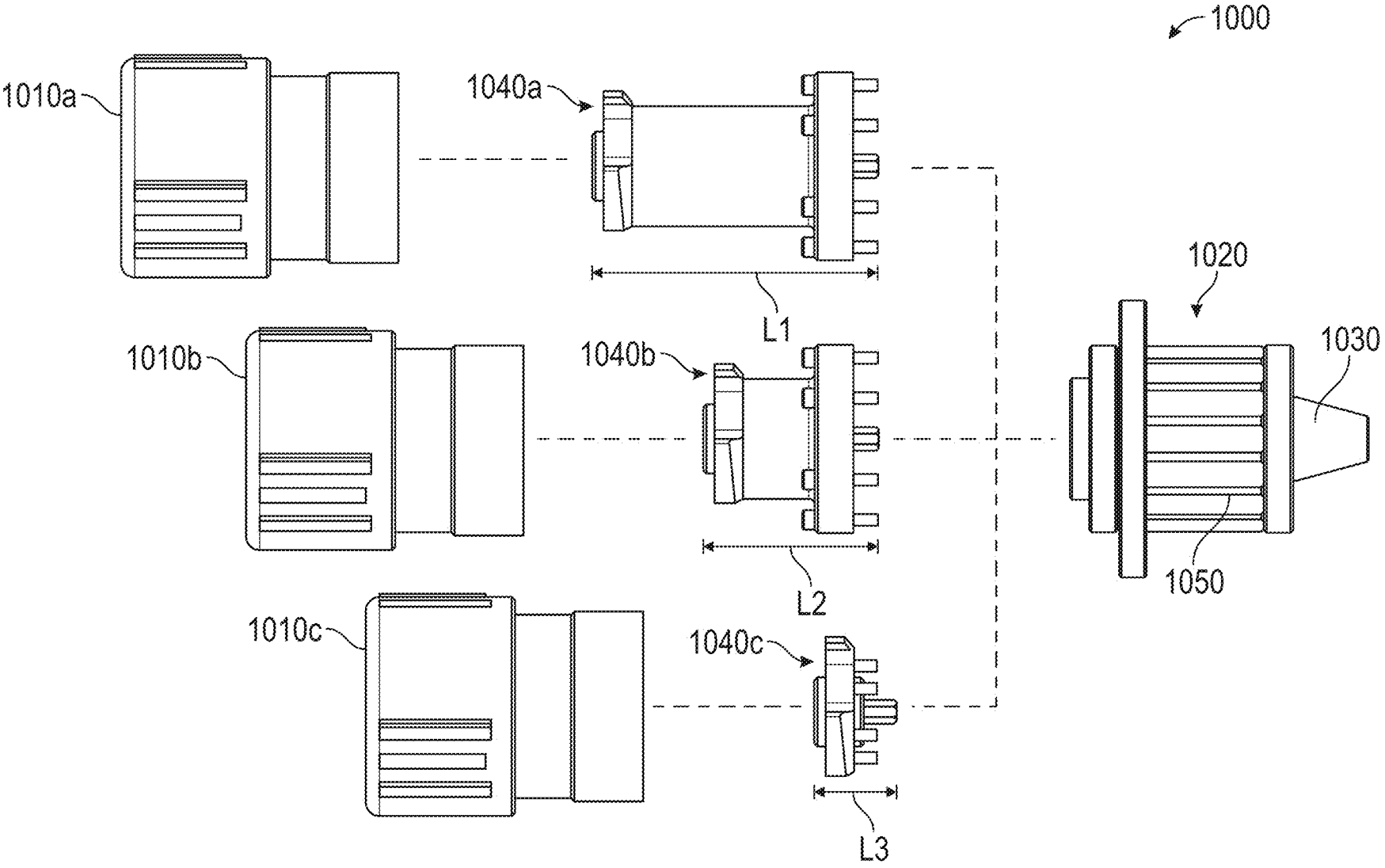
FIG. 10 illustrates a partially-schematic side view of a tool system configured in accordance with additional embodiments of the present technology.

FIG. 10 illustrates a schematic side view of a tool system 1000 configured in accordance with additional embodiments of the present technology. The tool system 1000 may generally function similarly to the tool system 400 described above with regard to FIG. 4. In addition, the tool system 1000 includes a distribution and collection system for refreshing and/or replacing the abrasive paper that enables pre-loaded head portions and can include extension elements for customizing the overall length of the tool system 1000, as described in further detail below with regard to FIGS. 10-13B.

With continuing reference to FIG. 10, in some embodiments, the tool system 1000 can include interchangeable head portions 1010*a*, 1010*b*, 1010*c*. The interchangeable head portions 1010*a*, 1010*b*, 1010*c* can have various dimensions (e.g., diameters), in a manner similar to the interchangeable head portions 110*a*, 110*b*, 110*c* described above with regard to FIG. 4. The interchangeable head portions 1010*a*, 1010*b*, 1010*c* can carry the abrasive paper and part of the distribution and collection system, as described in further detail below. The tool system 1000 can further include a common arbor portion 1020, which can be attached to a rotational input source at an end 1030. The tool system 1000 can further include interchangeable extension elements 1040*a*, 1040*b*, 1040*c* positionable between the common arbor 1020 and the interchangeable head portions 1010*a*, 1010*b*, 1010*c*. The interchangeable extension elements (e.g., 1040*a*, 1040*b*, 1040*c*) can have different lengths (e.g., L1, L2, L3) to selectively configure the tool system 1000 according to various applications (e.g., a longer extension for reaching deeper into a bore). When a head portion (e.g., 1010*a*, 1010*b*, 1010*c*) is attached to the common arbor 1020 (e.g., via an interchangeable extension element 1040*a*, 1040*b*, 1040*c*), and when the end 1030 is attached to a rotational input source, the rotational input source can rotate the head portion to slide abrasive paper across the working surface (e.g., the interior surface of a bore), in a manner similar to the function of the tool system 400 described above with regard to FIG. 4. When an operator wants to refresh the abrasive paper, the operator can rotate a twist ring 1050 to operate the distribution and collection system.

Figure 11:
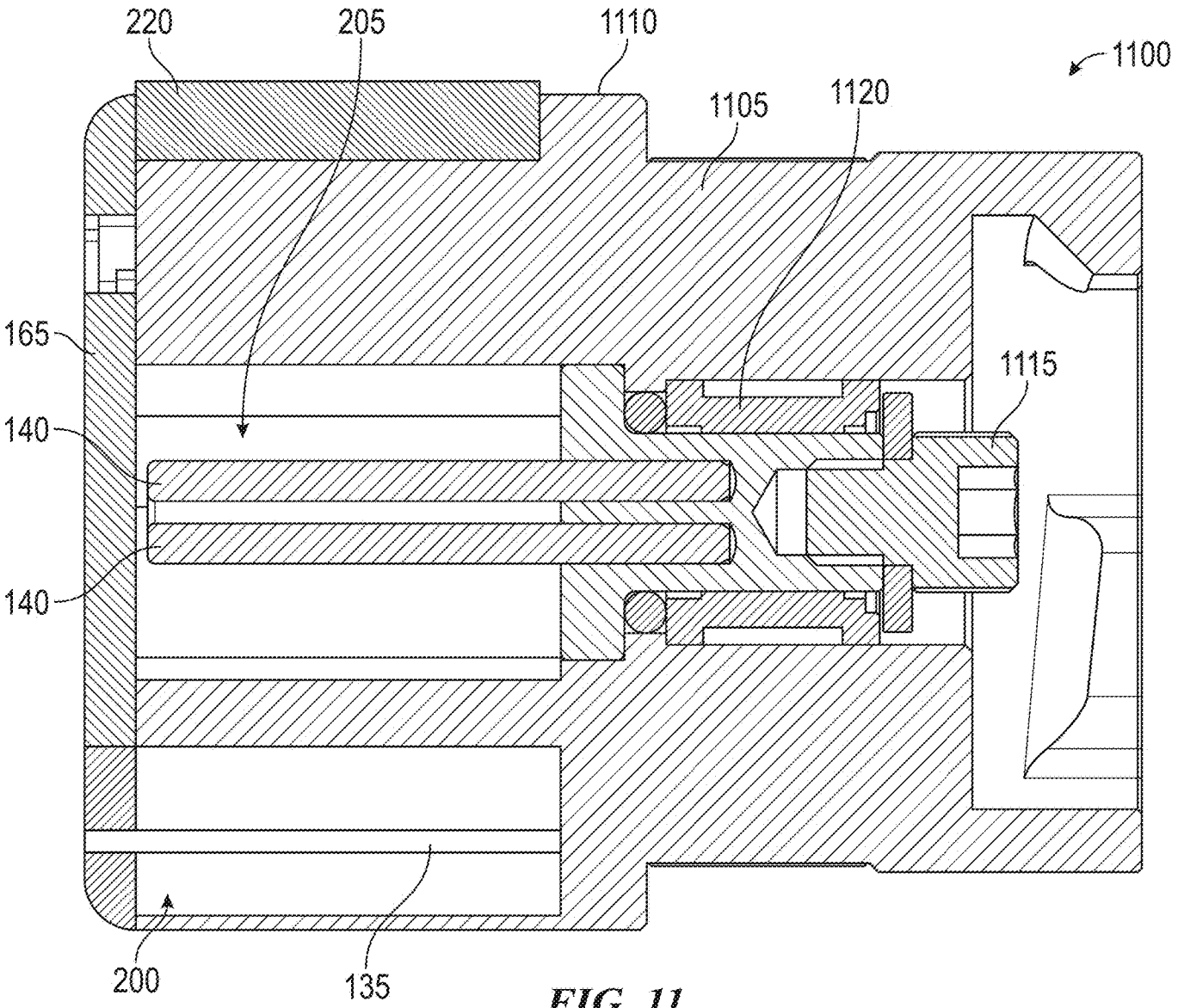
FIG. 11 illustrates a partially-schematic cross-sectional view of an interchangeable head portion configured in accordance with embodiments of the present technology.

FIG. 11 illustrates a partially-schematic cross-sectional view of an interchangeable head portion 1100 configured in accordance with embodiments of the present technology. The interchangeable head portion 1100 can be implemented in the tool system 1000 as one of the interchangeable head portions 1010*a*, 1010*b*, 1010*c*, or in other tool systems. In some embodiments, the head portion 1100 is generally similar to the head portion 110 described above with regard to FIG. 2. For example, the head portion 1100 can include a body portion 1105 with one or more media distribution regions 200 for receiving and/or containing abrasive paper (e.g., abrasive paper 133 described above), optional media distribution elements 135, one or more media collection regions 205 positioned to contain the abrasive paper, and/or media channels 155 (see FIG. 2 and the corresponding description). Like the head portion 110 described above, during operation of the head portion 1100, the abrasive paper passes from the media distribution regions 200, through the media channels 155 (see FIG. 2), across a surface 1110 of the body portion 1105 where it can be applied to the internal surface of a bore, and back into the body portion 1105 to be collected in the media collection regions 205 (e.g., using the one or more media collection elements 140).

In some embodiments, as shown for example in FIG. 11, the media collection elements 140 may be carried by the head portion 1100, as opposed to being carried by the arbor portion like in embodiments described above in connection with FIG. 6. Carrying the media collection elements 140 in the head portion 1100 enables the head portion 1100 to be pre-loaded with abrasive paper and allows replacement of the abrasive paper by swapping the head portion 1100 with another head portion 1100. In some embodiments, the body portion 1100 carries a rotatable input element 1115 attached to the media collection elements 140 and positionable to receive a rotational input to cause the media collection elements 140 to collect abrasive paper. The rotational input element 1115 is rotatably supported in the body portion 1100 via a first (or forward) one-way bearing 1120, which can be similar in structure and function to the one-way bearing 605 describe above in connection with FIG. 6. For example, the one-way bearing 1120 allows the rotational input 1115 to rotate the media collection elements 140 to collect the abrasive paper, but the one-way bearing 1120 resists and/or prevents the rotational input element 1115 (and the media collection elements 140) from rotating in the opposite direction (i.e. the one-way bearing 1120 resists or prevents unwinding the abrasive paper from the media collection elements 140).

Figure 12:
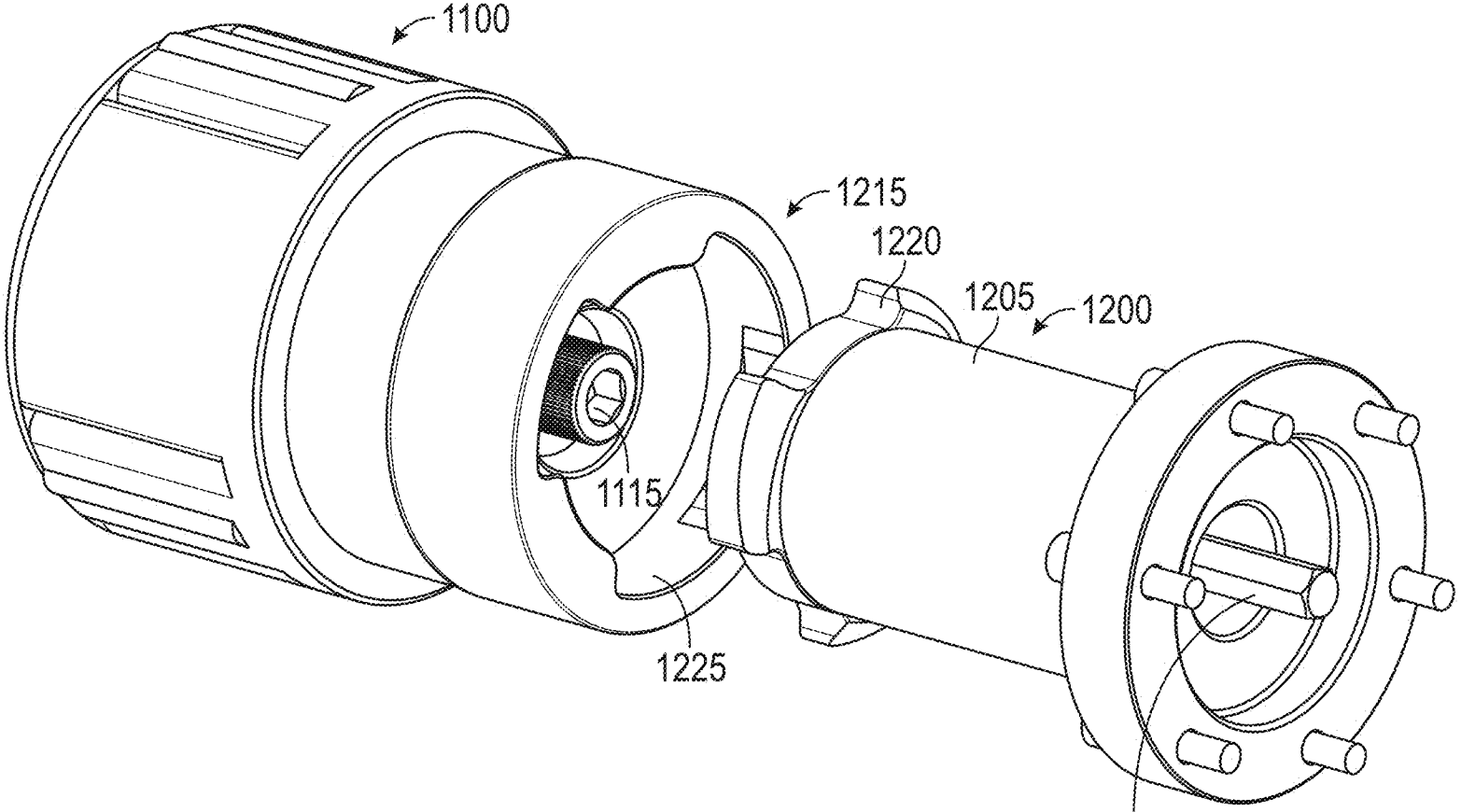
FIG. 12 illustrates a partially-schematic perspective view of the interchangeable head portion shown in FIG. 11, and an interchangeable extension element configured in accordance with embodiments of the present technology.

FIG. 12 illustrates a partially-schematic perspective view of the interchangeable head portion 1100 and an interchangeable extension element 1200 configured in accordance with embodiments of the present technology. The interchangeable extension element 1200 can be implemented in the tool system 1000 as one of the interchangeable extension elements 1030*a*, 1030*b*, 1030*c*, or in other tool systems. In some embodiments, the extension element 1200 can include a body portion 1205 and an extension driveshaft 1210 rotatably supported inside the body portion 1205. The extension element 1200 and the head portion 1100 can be joined at an attachment interface 1215. When the extension element 1200 and the head portion 1100 are joined at the attachment interface 1215, the extension driveshaft 1210 (which passes through the body portion 1205) can engage the rotational input 1115 to rotate the media collection elements 140 (see FIG. 11). In some embodiments, the attachment interface 1215 includes a quick-change interface with interlockable elements 1220 (e.g., teeth) on the body portion 1205 engageable with one or more interlockable cavities 1225. The attachment interface 1215 facilitates fast and/or toolless removal and replacement of the head portion 1100. In some embodiments, the one-way bearing 1120 could be positioned in the extension element 1200 rather than in the head portion 1100, and/or the extension element 1200 may include its own one-way bearing.

Figure 13A:
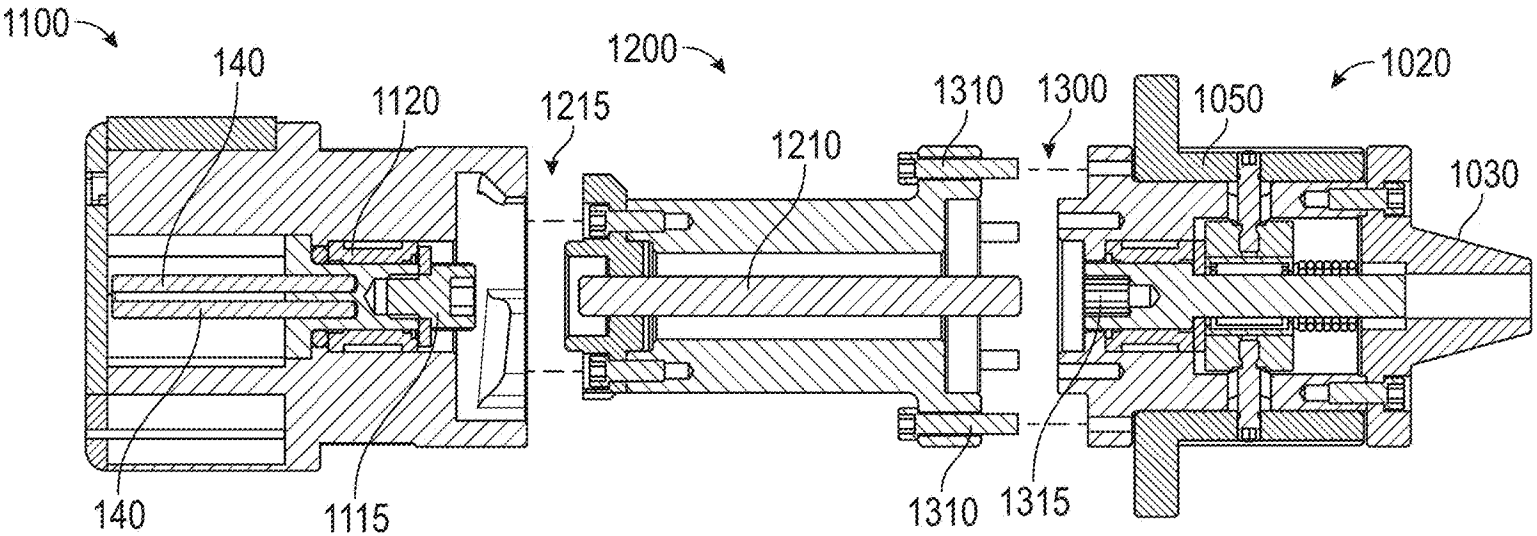
FIG. 13A illustrates a partially-schematic side cross-sectional view of portions of the tool system shown in FIG. 10, in a disassembled configuration, according to embodiments of the present technology.
Figure 13B:
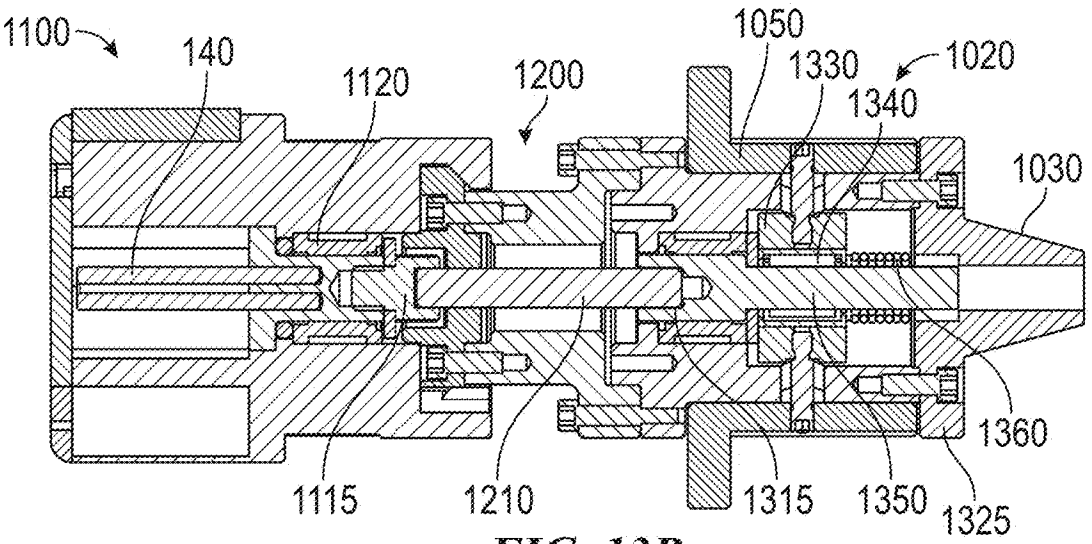
FIG. 13B illustrates a partially-schematic side cross-sectional view of the portions of the tool system shown in FIG. 13A, in an assembled configuration.

FIG. 13A illustrates a partially-schematic side cross-sectional view of portions of the tool system 1000 in a disassembled configuration, according to embodiments of the present technology. FIG. 13B illustrates a partially-schematic side cross-sectional view of the portions of the tool system shown in FIG. 13A, in an assembled configuration. With reference to FIG. 13A, the extension element 1200 can be joined to the common arbor 1020 at an attachment interface 1300, which can include fastening the extension element 1200 to the common arbor 1020 using one or more fasteners 1310, such as screws or bolts. The extension driveshaft 1210 is engageable with a rotational output 1315 of the arbor portion 1020.

With reference to FIG. 13B, when the head portion 1100, the extension element 1200, and the arbor portion 1020 are connected together, the assembly may be positioned in a lathe or other rotating object engaging with the end 1030. When the lathe rotates, the head portion 1100 rotates and works the inner surface of a bore. When a user wants to refresh abrasive paper (i.e., by collecting used abrasive paper on the collection elements 140 and passing new paper to the surface of the head portion 1100), the user can pause the lathe and rotate the twist ring 1050, which can be supported by a body portion 1325 of the arbor portion 1020. The twist ring 1050 can rotate relative to the body portion 1325, and it can be connected to a clutch ring 1330, which in turn can be connected to another one-way bearing 1340 (e.g., a second/rearward one-way bearing), which in turn can be connected to an arbor driveshaft 1350 that connects to the extension driveshaft 1210 in the extension element 1200 via the rotational output 1315. When the user rotates the twist ring 1050 along a first direction, the clutch ring 1330 rotates the arbor driveshaft 1350, which rotates the extension driveshaft 1210 (if an optional extension element 1200 is included), the rotational input 1115, and the media collection elements 140, which can collect the abrasive paper. When a user releases the twist ring 1050, a biasing element 1360 connected to the clutch ring 1330 and the body portion 1325 can return the twist ring 1050 to its original position. Accordingly, the structure and operation of the twist ring 1050 to rotate the rotational output 1315 and return to its original position can be similar to the structure and operation of the twist ring 150 to rotate the arbor driveshaft 600 in accordance with embodiments described above in connection with FIGS. 1-8.

Advantages of embodiments of the present technology include more efficient bore polishing and/or finishing operations by enabling an operator to replace or refresh abrasive material quickly and/or automatically. Embodiments of the present technology enable bore finishing processes to be more repeatable and/or consistent than conventional processes. Embodiments of the present technology also reduce or eliminate the need for an operator to put a finger inside of a rotating workpiece and improve consistency among groups of operators. Components of the present technology can be formed from any suitable material and using any suitable manufacturing technique, such as additive manufacturing (e.g., "3-D printing"), casting, machining, etc.

From the foregoing, it will be appreciated that specific embodiments of the disclosed technology have been described herein for purposes of illustration, but that various modifications may be made without deviating from the technology. For example, although embodiments of the present technology can be implemented in tool systems for polishing internal bore surfaces, embodiments of the present technology can further include tool systems for polishing or otherwise working other surfaces, including external surfaces that are not within a bore. Although abrasive paper is an example media, other media may be implemented, and it need not perform an abrasive function (e.g., embodiments of the present technology may apply a material rather than polish or otherwise modify a surface). Although some embodiments can include a media collection element for each media distribution element, in some embodiments, there can be one media collection element for multiple media distribution elements. In some embodiments, the head portion can carry one or more of the media distribution elements and/or one or more of the media collection elements.

Although specific quantities, dimensions, or other numerical characterizations are provided for context and/or to indicate representative embodiments, various further embodiments can have other quantities, sizes, or characteristics (for example, sizes, quantities, and/or characteristics commensurate with strength requirements or other variables).

Certain aspects of the technology described in the context of particular embodiments may be combined or eliminated in other embodiments. Further, while advantages associated with certain embodiments of the disclosed technology have been described in the context of those embodiments, other embodiments may also exhibit such advantages, and not all embodiments need necessarily exhibit such advantages to fall within the scope of the present technology. Accordingly, the present disclosure and associated technology can encompass other embodiments not expressly shown or described herein.

As used herein, the term "and/or" when used in the phrase "A and/or B" means "A, or B, or both A and B." A similar manner of interpretation applies to the term "and/or" when used in a list of more than two terms. As used herein, the terms "generally" and "approximately" refer to values or characteristics within a range of ±10% from the stated value or characteristic, unless otherwise indicated.

We claim:

1. A tool system comprising an arbor portion and a head portion, wherein:

(a) the arbor portion comprises:
- a body portion;
- one or more media collection elements carried by the body portion;
- a rotation mechanism carried by the body portion and positioned to rotate the one or more media collection elements relative to the body portion; and
- one or more media distribution elements; and (b) the head portion comprises:
- one or more media distribution regions, wherein each of the one or more media distribution regions is positioned to receive individual media distribution elements of the one or more media distribution elements;
- a media collection region, wherein the media collection region is positioned to receive the one or more media collection elements;
- at least one outbound media channel extending from a corresponding media distribution region of the one or more media distribution regions to a first opening at an exterior perimeter of the head portion; and
- at least one inbound media channel extending from a second opening at the exterior perimeter of the head portion, to the media collection region.

2. The tool system of claim 1, wherein the head portion further comprises a peripheral element positioned at the exterior perimeter of the head portion, between the first opening and the second opening.

3. The tool system of claim 2, wherein the peripheral element comprises a flexible and/or resilient element extending radially beyond the exterior perimeter of the head portion.

4. The tool system of claim 3, wherein the peripheral element comprises foam.

5. The tool system of claim 1, wherein the head portion is removable from, and replaceable upon, the arbor portion.

6. The tool system of claim 5, wherein the head portion is a first head portion, and the tool system further comprises one or more additional head portions, wherein each of the first head portion and the one or more additional head portions has a different external diameter, and wherein each of the first head portion and the one or more additional head portions are removable and replaceable on the arbor portion.

7. The tool system of claim 5, wherein the head portion is removable from, and replaceable upon, the arbor portion via one or more fastener elements extending into the arbor portion and/or into the head portion.

8. The tool system of claim 1, further comprising a flexible arbor support structure attachable to an end of the arbor portion opposite the head portion.

9. The tool system of claim 1, further comprising media positionable within the head portion, wherein the media comprises abrasive paper.

10. The tool system of claim 1, wherein the head portion is cylindrical and coaxial with the arbor portion.

11. The tool system of claim 1, wherein the body portion is cylindrical and positionable in a lathe.

12. The tool system of claim 1, wherein the rotation mechanism comprises one or more one-way bearings and a twist ring carried by the body portion.

13. The tool system of claim 12, wherein the rotation mechanism comprises a return spring positioned to bias the twist ring toward a first direction.

14. The tool system of claim 1, wherein the one or more media collection elements comprises a reel or a plurality of posts extending longitudinally from the body portion.

15. The tool system of claim 1, wherein the one or more media distribution elements comprise a spool or a post extending longitudinally from the body portion.

16. A tool system comprising an arbor portion and one or more interchangeable head portions, wherein the arbor portion comprises:

a body portion;

a media collection element carried by the body portion;

a rotation mechanism carried by the body portion and positioned to rotate the media collection element relative to the body portion; and a media distribution element.

17. The tool system of claim 16, wherein at least one of the one or more interchangeable head portions comprises:

a media distribution region positioned to receive the media distribution element;

a media collection region positioned to receive the media collection element; and one or more pathways connecting the media distribution region, the media collection region, and a perimeter surface of the at least one of the one or more interchangeable head portions.

18. The tool system of claim 16, wherein the rotation mechanism comprises one or more one-way bearings, a twist ring positioned at a perimeter of the body portion, and a biasing element, wherein the rotation mechanism is positioned and configured to cause rotation of the media collection element in a first direction when an operator rotates the twist ring relative to the body portion, and to resist rotation of the media collection element in a second direction opposite the first direction.

19. A tool system for polishing a bore, the tool system comprising:

a first rotatable shaft;

a second rotatable shaft;

a media collection element connected to the first rotatable shaft and positioned to rotate when the first rotatable shaft rotates;

a head portion connected to the second rotatable shaft and positioned to rotate when the second rotatable shaft rotates; and a transmission connecting the first rotatable shaft to the second rotatable shaft, wherein the transmission causes the second rotatable shaft and the head portion to rotate slower than the first rotatable shaft.

20. The tool system of claim 19, wherein the head portion comprises:

a media distribution region;

one or more openings at an external peripheral surface of the head portion; and one or more pathways connecting the media distribution region to the one or more openings and to the media collection element.

21. A tool system for polishing a bore, the tool system comprising an arbor portion and a head portion, wherein:

(a) the arbor portion comprises:

a body portion;

an arbor driveshaft positioned in the body portion and rotatable relative to the body portion; and a rotation mechanism carried by the body portion and positioned to rotate the arbor driveshaft relative to the body portion;

(b) the head portion comprises:

one or more media distribution regions positioned to receive abrasive paper;

at least one outbound media channel extending from a corresponding media distribution region of the one or more media distribution regions to a first opening at an exterior perimeter of the head portion;

at least one inbound media channel extending from a second opening at the exterior perimeter of the head portion, to a media collection region; and one or more media collection elements positioned in the media collection region;

wherein the one or more media collection elements are operatively connected to a rotatable input element supported by a body of the head portion; and (c) the head portion is directly or indirectly connectable to the arbor portion, wherein when the head portion is connected to the arbor portion, rotation of the arbor driveshaft causes the one or more media collection elements to rotate.

22. The tool system of claim 21, further comprising one or more additional head portions, wherein each of the head portions is configured to connect and disconnect from the arbor portion, and wherein each individual head portion comprises a different outer diameter than each other individual head portion.

23. The tool system of claim 21, further comprising one or more extension elements positionable between the arbor portion and the head portion to connect the arbor portion to the head portion, wherein:

each individual extension element comprises a different length than each other individual extension element;

each extension element comprises a body portion and a driveshaft rotatably supported within the body portion;

the driveshaft is connectable to the rotatable input element and the arbor driveshaft; and when the driveshaft is connected to the rotatable input element and the arbor driveshaft, and when the arbor driveshaft rotates, the one or more media collection elements rotate.

24. The tool system of claim 21, wherein the rotation mechanism comprises one or more one-way bearings, a twist ring positioned at a perimeter of the body portion, and a biasing element, wherein the rotation mechanism is positioned and configured to cause rotation of the arbor driveshaft in a first direction when an operator rotates the twist ring relative to the body portion, and to resist rotation of the one or more media collection elements in a second direction opposite the first direction.

* * * * *